US007913837B2

(12) United States Patent
Cuomo

(10) Patent No.: US 7,913,837 B2
(45) Date of Patent: Mar. 29, 2011

(54) CARRIER AND METHOD

(75) Inventor: Angelo V. Cuomo, Staten Island, NY (US)

(73) Assignee: SJV Food & Beverage Carriers, Inc., Clark, NJ (US)

( * ) Notice: Subject to any disclaimer, the term of this patent is extended or adjusted under 35 U.S.C. 154(b) by 969 days.

(21) Appl. No.: 11/499,421

(22) Filed: Aug. 4, 2006

(65) Prior Publication Data

US 2008/0230406 A1 Sep. 25, 2008

Related U.S. Application Data

(63) Continuation-in-part of application No. 11/443,962, filed on May 30, 2006, now Pat. No. 7,690,502, and a continuation-in-part of application No. 11/345,898, filed on Feb. 2, 2006, now Pat. No. 7,753,195, and a continuation-in-part of application No. 11/301,407, filed on Dec. 13, 2005, now Pat. No. 7,438,181, and a continuation-in-part of application No. 11/301,913, filed on Dec. 13, 2005, now Pat. No. 7,475,772, and a continuation-in-part of application No. 11/012,789, filed on Dec. 15, 2004, now Pat. No. 7,370,755, and a continuation-in-part of application No. 11/012,440, filed on Dec. 15, 2004, now Pat. No. 7,383,949, and a continuation-in-part of application No. 10/939,264, filed on Sep. 10, 2004, now Pat. No. 7,604,115, and a continuation-in-part of application No. 10/737,612, filed on Dec. 16, 2003, now Pat. No. 7,267,224, and a continuation-in-part of application No. 10/662,265, filed on Sep. 15, 2003, now Pat. No. 7,243,785, and a continuation-in-part of application No. 10/215,938, filed on Aug. 9, 2002, now Pat. No. 7,185,758.

(51) Int. Cl.
*B65D 75/00* (2006.01)

(52) U.S. Cl. ..... 206/162; 206/175; 206/427; 206/139; 229/117; 229/117.24; 229/117.14

(58) Field of Classification Search ..... 206/162, 206/175, 193, 147, 174, 194, 199, 139, 427, 206/141; 229/117, 117.14, 117.12, 117.26, 229/183, 164

See application file for complete search history.

(56) References Cited

U.S. PATENT DOCUMENTS

| | | | | | |
|---|---|---|---|---|---|
| 1,977,102 | A | * | 10/1934 | Wheeler | 206/167 |
| 2,006,725 | A | * | 7/1935 | Usinger | 206/169 |
| 2,011,232 | A | | 8/1936 | Parks | |
| 2,300,874 | A | * | 11/1942 | De Ferrari | 206/194 |
| 2,513,079 | A | | 6/1950 | Buerger | |
| RE23,501 | E | * | 5/1952 | Lighter | 206/198 |
| 2,630,264 | A | | 4/1953 | Holy | |
| 2,659,526 | A | * | 11/1953 | Buttery | 229/117 |

(Continued)

*Primary Examiner* — David T Fidei
(74) *Attorney, Agent, or Firm* — Gregor N. Neff, Esq.

(57) ABSTRACT

One embodiment of the carrier has a central vertical support panel structure with two foldable receptacles extending outwardly from the vertical support panel structure. The outside wall of each receptacle is extended upwardly and bent over to cover the receptacle, and the top portions of those walls are joined together to form a carrying handle structure, either with or without the upper portion of the vertical support panel structure. The portions of the outside walls forming the covers can have openings to receive the necks of bottles such as wine and beer bottles to give added lateral support for the bottles. A simplified embodiment uses only one of the foldable receptacles and has two lateral side walls which extend upwardly and join together to form a handle structure.

12 Claims, 7 Drawing Sheets

U.S. PATENT DOCUMENTS 2,702,154 A * 2/1955 Linson ..... 229/114
2,881,946 A 4/1959 Bosrock et al.
2,991,908 A 4/1960 Conescu
2,997,021 A 8/1961 Bailey
3,158,286 A 11/1964 Phillips, Jr.
3,576,274 A 4/1971 Stramaglia
3,814,238 A * 6/1974 Wood ..... 206/167
3,927,824 A * 12/1975 Razziano ..... 229/117
4,089,457 A * 5/1978 Wood et al. ..... 229/120.24
4,308,995 A * 1/1982 Hanes ..... 229/117.15
4,378,880 A 4/1983 Summers
4,610,349 A 9/1986 Schwartz et al.
4,767,051 A 8/1988 Single
4,770,294 A 9/1988 Graser
4,836,367 A 6/1989 Golkar
5,275,331 A * 1/1994 Chung-Piao ..... 229/117.15
5,590,762 A * 1/1997 Harrelson ..... 206/162
5,695,051 A 12/1997 Hart
5,709,298 A 1/1998 Harris
5,927,502 A 7/1999 Hunter
5,927,593 A * 7/1999 Berkowitz et al. ..... 229/117
6,092,716 A * 7/2000 Smith ..... 229/117.04
6,341,689 B1 1/2002 Jones
6,443,308 B1 9/2002 Davis
6,571,941 B2 * 6/2003 Holley, Jr. ..... 206/162
2003/0230499 A1 * 12/2003 Wagner ..... 206/216
2005/0011777 A1 * 1/2005 Bruno ..... 206/139
2005/0103651 A1 * 5/2005 Lebras ..... 206/162
2006/0091190 A1 * 5/2006 Nikolai ..... 229/117.14

* cited by examiner

Fig.17
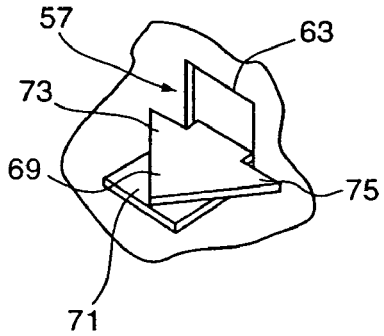
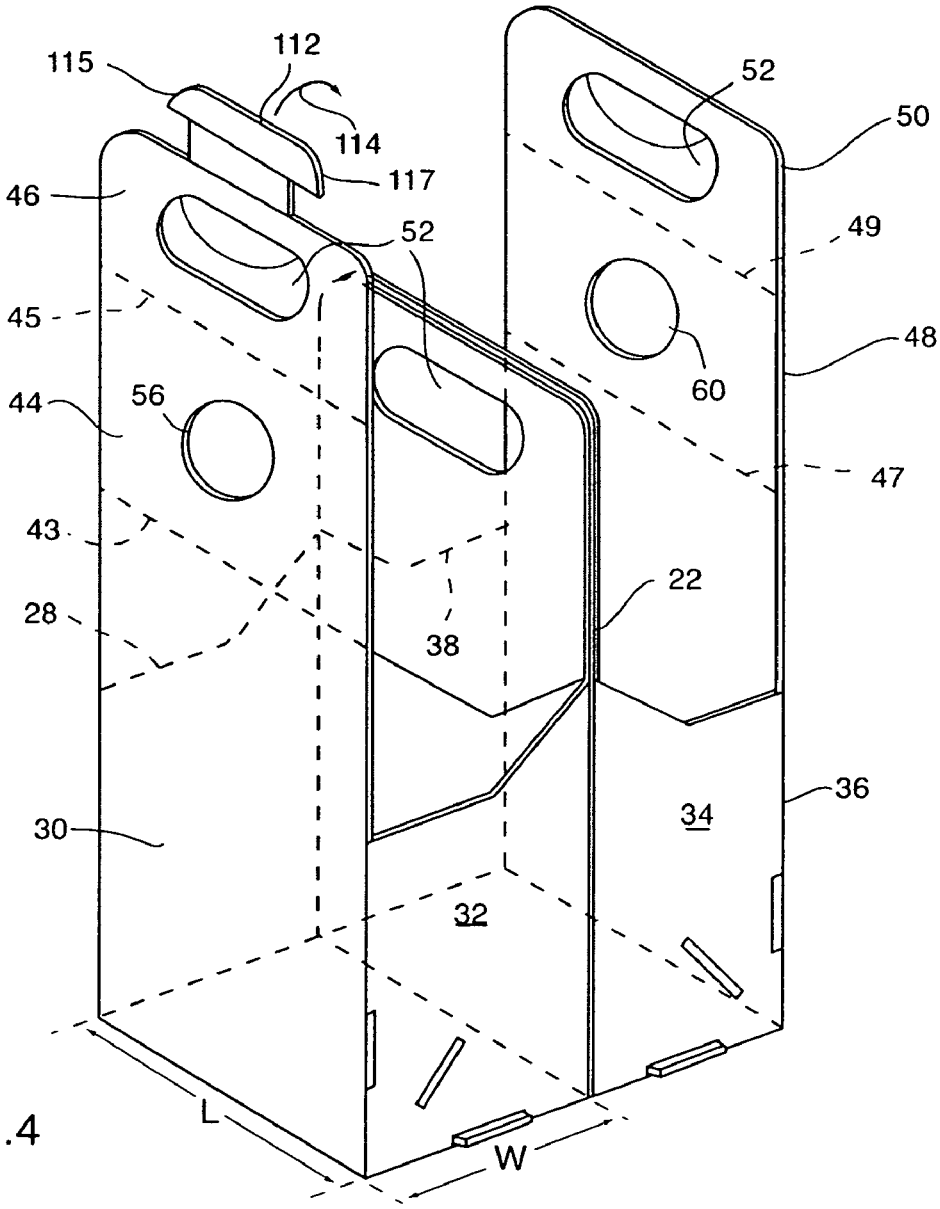
Fig.4

GLUE
FOLD
FOLD
FOLD
FOLD#4
GLUE
FOLD
FOLD
FOLD
FOLD

CARRIER AND METHOD

This patent application is a continuation-in-part of U.S. patent application Ser. No. 10/215,938 filed Aug. 9, 2002 now U.S. Pat. No. 7,185,758; Ser. No. 10/662,265, filed Sep. 15, 2003 now U.S. Pat. No. 7,243,785; Ser. No. 10/737,612 filed on Dec. 16, 2003 now U.S. Pat. No. 7,267,224; Ser. No. 10/939,264 filed on Sep. 10, 2004 now U.S. Pat. No. 7,604,115, Ser. No. 11/012,440 filed on Dec. 15, 2004 now U.S. Pat. No. 7,383,949, Ser. No. 11/012,789, filed Dec. 15, 2004 now U.S. Pat. No. 7,370,755, Ser. No. 11/301,913, filed Dec. 13, 2005 now U.S. Pat. No. 7,475,772, Ser. No. 11/301,407, filed Dec. 13, 2005 now U.S. Pat. No. 7,438,181, Ser. No. 11/345,898, filed Feb. 2, 2006 now U.S. Pat. No. 7,753,195, and Ser. No. 11/443,962, filed May 30, 2006 now U.S. Pat. No. 7,690,502. The disclosures of those patent applications are hereby incorporated herein by reference.

This invention relates to carriers for beverages, food, liquids in containers and other objects, and to methods of making and using such carriers.

Although the carriers of the foregoing patent applications are excellent for most purposes, it is desired to provide modified versions of those carriers which are able to carry and protect objects of diverse sizes and shapes and to form covers over the receptacles containing the objects to be carried. It also is an object of the invention to provide simplified and more economical carriers having the desired characteristics.

In accordance with the invention, a carrier is provided in which outside walls are used to form handles and simultaneously cover all or a portion of the tops of the receptacles containing objects to be carried.

The covers can be provided with holes or slots through which the necks of bottles such as wine or beer bottles can protrude. This can provide valuable lateral support for tall objects to be carried, while partially covering upper surface portions of those objects.

Extra strength can be added to the handle structure by extending the central vertical panel structure upwardly and joining it with the extended outside walls to form a reinforced multi-ply handle structure.

Throughout most of its variations, the invention maintains the use of a pair of vertical support panels, a foldable receptacle extending outwardly from each panel, with the vertical support panels being secured together back-to-back, with each forming one side wall of one of the receptacles.

The preferred rectangular bottom structure for each receptacle is formed of four flanges, one extending downwardly from each of the four side walls of the receptacle. Each of two flanges is secured to an adjacent flange and the combination is folded diagonally at opposed corners of the rectangular structure. This bottom structure is strong and unfolds easily and automatically when the carrier is unfolded.

The bottom structure preferably has a wide flange and, optionally, a tab-and-slot detent structure to hold a partially-unfolded carrier open for filling.

As a result, carriers of the invention provide an economical covered or partially-covered carrier which is strong and relatively easy to fill, and is able to support beverage containers of a variety of sizes and shapes, especially tall necked containers.

The invention also provides an improved method for packaging items for carry-out from an alcoholic beverage store, grocery or convenience store, restaurant, sports arena concession stand, etc. Carriers of the invention of a single size, or of a small number of different sizes, can be used to better and more safely carry beverage containers of a wide variety of sizes and shapes. Thus, tall necked wine or beer bottles can be given good lateral support by the covers provided over the receptacles, with holes available to give lateral support for the necks of bottles to be carried.

Pre-packaged beverages in cans or bottles can be protected from dust and accidental spillage by means of the invention. The covers over the tops of the receptacles hold the beverage containers in the receptacles until the carrier cover is torn open. In the typical automatic carton filling equipment, the carrier is simply unfolded, filled with beverage containers, and the two outside walls are brought together and secured to one another. The carriers are selected so that the containers substantially fill the compartments in the carrier, and the outside walls are secured together so as to hold the containers together in a tight package.

In one particularly simplified embodiment of the invention, a single receptacle of the above-described construction is provided with a handle and used for holding and carrying objects such as beverage cans, cups, or bottles, or the like.

Preferably, the latter embodiment has two opposed lateral side walls which extend to a height well above two end side walls, and there is a handle structure near the uppermost edge of each lateral side wall. The two handle structures can be grasped simultaneously with one hand, and/or a latch can be used to hold the handle structures together.

The foregoing and other objects and advantages of the invention will be apparent from or set forth in the following description and drawings.

IN THE DRAWINGS

FIG. 4 is a perspective view of the carrier of FIG. 1 in an erected but unfilled state;

FIG. 17 is an enlarged, broken-away view of a component of the carrier of FIG. 1;

GENERAL DESCRIPTION

Figure 1:
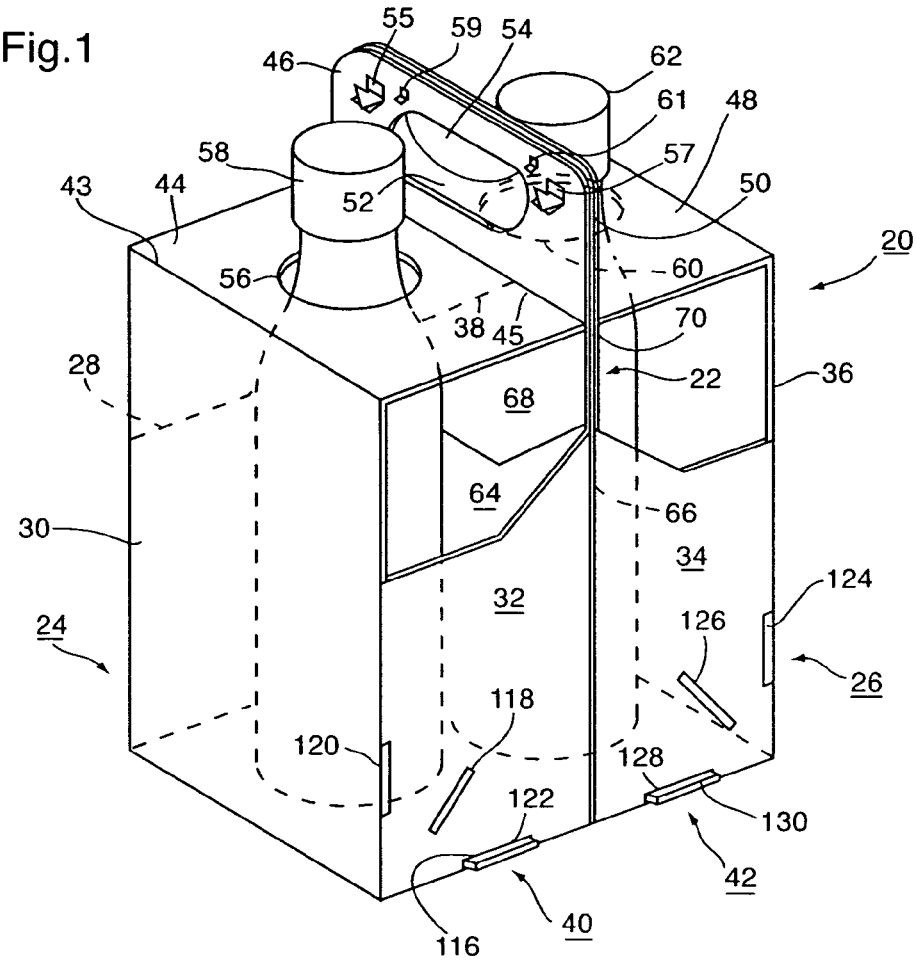
FIG. 1 is a perspective view of one embodiment of the carrier of the invention.

FIG. 1 is a perspective view of a carrier 20 constructed in accordance with the present invention. The carrier includes a vertical support panel structure 22 and, when unfolded, as shown in FIG. 1, includes two receptacles 24 and 26 which extend outwardly from opposite sides of the vertical support panel structure 22.

The first receptacle 24 includes a rear end wall 28, an outside wall 30, and a front end wall 32. One panel 64 forming the central vertical support panel structure 22 forms the fourth side wall of the receptacle 24.

Figure 5:
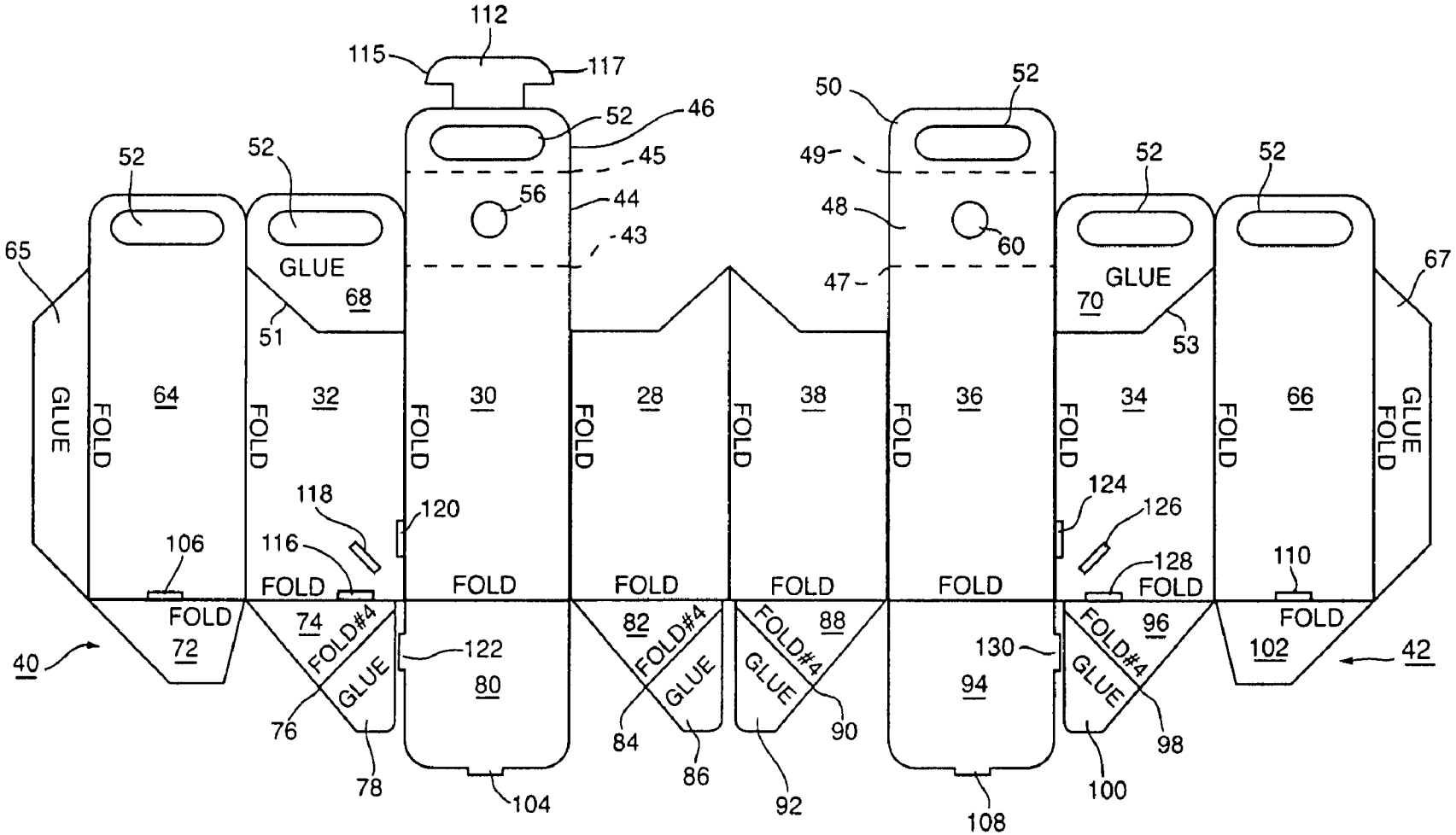
FIG. 5 is a top plan view of a blank used to make the carrier of FIG. 1.

Similarly, receptacle 26 includes a rear end wall 38, an outside wall 36, and a front end wall 34, as well as another panel 66 of the vertical support structure 22 (also see FIG. 5).

Each of the receptacles has a bottom structure 40 or 42 which is shown in greater detail in FIG. 5 and will be described below, and which has been described in some or all of the above-identified pending patent applications.

Each of the outside walls 30 and 36 is elongated so as to extend well above the upper edge of the two end walls 28 and 32 or 38 and 34.

The outside wall 30 has a section 44 foldable over along a fold line 43, and an upper edge section 46 formed by folding along another fold line 45.

Similarly, as shown in FIG. 5, the outside wall 36 has a section 48 defined by fold lines 47 and 49, and an upper edge section 50.

Each of the upper edge sections 46 and 50, as well as the upper edge sections of the panels making up the vertical panel structure 22 has a hand hole 52 with a hand guard 54. The hand holes 52 are aligned with one another and the upper edge sections are secured together so as to form a combined handle structure by means of which the carrier can be lifted and carried.

In accordance with one of the optional features of the invention, each of the panels 44 and 48 has a hole 56 or 60 positioned to receive the neck of a bottle 58 or 62 therethrough. This provides lateral support for the bottles near their upper ends so as to stabilize them and prevent them from falling from the receptacles in which they are carried.

As shown in FIG. 1, each of the bottles 58 or 62 has a diameter substantially smaller than the inside dimensions of the receptacle 24 or 26 in which it is located. This can come about when a carrier 20 of a standard size is used to package products which vary widely in size, as might be done in a carry-out retail store. By restraining the necks of the bottles by means of the panels 44 and 46 and the holes 56 and 60, etc., the carrier 20 can be used to carry a wide variety of bottles which might be too small to fit snugly in the carrier, or are tall with a tendency to tip, etc.

The carrier 20 has four locking structures 55, 57, 59, and 61 which are used to lock all of the parts of the handle structure together after the items to be carried have been loaded into the carrier.

FIG. 17 shows one of the four locking structures 57 in detail.

A rectangular hole 63 is die cut in all layers of the handle structure except one, in which an arrow-head shaped tab 69 is die-cut. The tab has two barbs 73 and 75 which project from the sides to a width somewhat wider than the width of the hole 63. The other three lock structures 55, 59, and 61 are of similar construction, except that the lock structures 59 and 61 are smaller than the structures 55 and 57. Material 71 only partially die cut is pushed outwardly when tab 69 is pushed through the hole 63.

In locking the handle layers together, the layers are brought together with the holes 63, etc., aligned with one another and the tabs 69, etc., aligned with the holes, and the tabs are pushed through the holes until the barbs 73, 75, etc., catch on the side edges of the holes to lock the panels together. The tabs can be pushed through the holes by hand, or by the movement of rods, if the carriers are filled by automatic bottling equipment.

The handle layers can be pulled apart by hand fairly easily, when the customer wishes to open the carrier to remove a beverage container.

DETAILED DESCRIPTION

FIG. 5 is a plan view of the blank used to make the carrier 20, except that an alternative handle lock structure is used Although a variety of different blanks can be used, the one shown in FIG. 5 is particularly well designed for fabrication using an automatic in-line gluing machine.

The blank includes a pair of panels 68 and 70 which are secured to the side walls 32 and 34, respectively, along weak perforated lines 51 and 53. During the gluing and folding process using automated equipment, the panels 68 and 70 are broken loose from the panels 32 and 34 and are folded over on the panels 64 and 66, respectively, and glued thereto in order to form a multi-ply handle structure.

Tabs 65 and 67 extend from the left and right edges of the blank and are glued and, when the panels are folded over, are attached, respectively, to the panels 38 and 28 to form the side walls of the receptacles 24 and 26.

The bottom structure 40 includes a first flange 72 which extends downwardly from panel 64, and a triangular flange 74, with a tab 78 and a diagonal fold line 76, extends downwardly from the panel 32. A broad panel 80 extends downwardly from the panel 30, and another triangular flange 82 with a tab 86 and diagonal fold line 84 extends downwardly from the panel 28.

Similarly, the bottom structure 42 for the receptacle 26 includes flanges 94 and 102, and triangular flanges 88, 96 with tabs 92, 100 and fold lines 90, 98 which are the mirror images of the corresponding flanges of the bottom structure 40.

Each of the broad flanges 80 and 94 has a tab 122 or 130 extending from one side and an end tab 104 or 108. The tab 122 or 130 cooperates with each of three slots 120, 118 and 116 or 124, 126, and 182, (also see FIG. 1) as the carrier is being unfolded to hold the receptacles open until objects have been placed in them. The placement of the objects in the receptacles presses the panels 80 and 94 downwardly until the tab 122 extends through the slot 116 and the tab 130 extends through the slot 128 to help hold the panel in a downward position. This feature of the invention is described in greater detail in some of the foregoing patent applications.

Glue is applied to the tabs 78, 86, 92, 100, 67, and 65, as well as to the surfaces of panels 68 and 70, and the panels are folded over upon one another to form the carrier structure which is folded and ready for shipment to a retail store, bottling facility or other place where it is loaded with items to be carried.

Still referring to FIG. 5, as well as FIG. 4, the locking structure includes a wide barbed male locking member or tab 112 extending from the upper edge of the panel 30. The tab 112 has two barbs 115, 117 extending to a width greater than that of the handle hole 52.

To lock the layers of the handle together, the panels are brought together with the holes 52 in alignment, and the tab 112 is folded over the upper edges of the panels, in the direction indicated by the arrow 114 in FIG. 4, and pushed through the holes 52 until the barbs 115, 117 are caught on the edges of the panel 46 to lock the panels together. This locking is easy to perform by hand, without any tools.

Other known locking structures can be used instead of those shown in FIGS. 1, 4, 5 and 17, if desired.

Alternative Bottle Neck Hole Shapes

Figure 2:
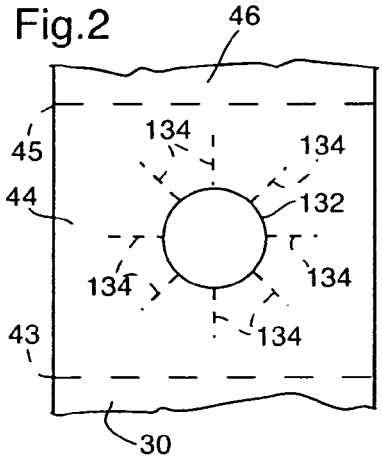
FIGS. 2 and 3 are broken-away plan views of alternative embodiments of the carrier of the invention.
Figure 3:
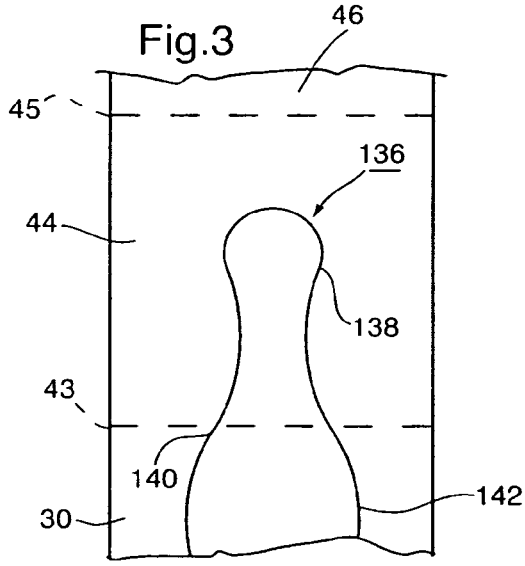

FIGS. 2 and 3 are broken away views of the panels 43 and 46 with alternative hole shapes which can be used to accommodate the necks of bottles of varying sizes.

The embodiment shown in FIG. 2 provides a circular hole 132 with radial perforations 134 extending outwardly from the edges of the hole. When a bottle neck of a diameter larger than the diameter of the hole 132 is thrust through the hole 132, the perforations 134 break and enlarge the hole to accommodate the larger bottle neck.

FIG. 3 is an elongated opening 136 with a generally wasp-like shape. It has an enlarged upper portion 138, a neck portion 140 and an enlarged lower portion 142. The elongated hole extends past the fold line 43 and downwardly into the panel 30. It is provided so that the panels 30 and 44 will be bendable to fit the contours of a larger bottle and give it added support. Openings of the shape shown in FIG. 3 are illustrated in some of the embodiments set forth hereinbelow.

FIG. 4 shows the unfolded carrier 20, with the alternative handle lock, in the position which the carrier takes prior to being loaded with objects to be carried. As it can be seen, the outside walls 30 and 36 with the extensions 44 and 46 and 48 and 50 make the panels extend well above the upper edge of the vertical support panel structure 22.

It should be understood that the dimensions of the various panels 44, 46 and 30 can be varied in order to accommodate different products to be carried. For example, the panels 44 and 48 are horizontal as shown in FIG. 1, and yet they need not be. Instead, they can be positioned at an angle as desired and needed. Also, holes of other shapes can be used to accommodate the bottle necks. The holes can be oval, rectilinear, or of any shape desired and suited to the purpose.

FURTHER ALTERNATIVE EMBODIMENTS

Figure 6:
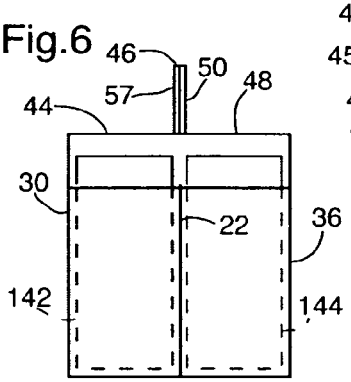
FIGS. 6, 7 and 8 are, respectively, end elevation, side elevation and top plan views of another embodiment of the invention.
Figure 7:
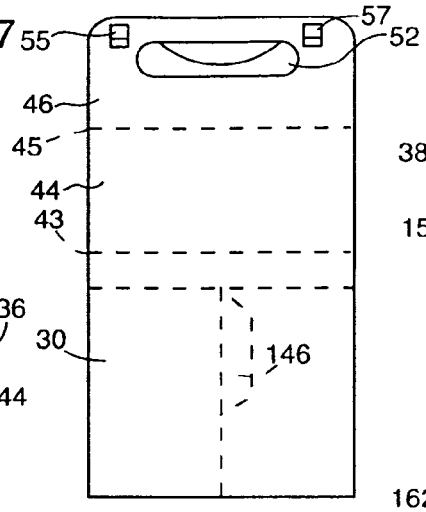
Figure 8:
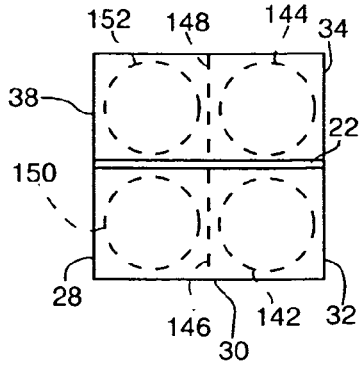

FIGS. 6, 7 and 8 show the carrier of FIG. 1 in use as a six-pack carrier for beverage cans 142 and 144. The panels 44 and 48, in this case, have no holes in them so that they completely cover the tops of the cans in the carrier.

As it is shown in FIGS. 6 and 7, dividers 146 and 148 are provided to divide the carrier into different compartments in which the cans are located. In the embodiment shown in FIGS. 6-8, there are four such compartments and a beverage can is located in each, as it is shown in FIG. 8, in which cans 150 and 152 are shown in addition to the cans 142 and 144. Of course, the carrier can be made to carry 6, 12 or other numbers of cans, as needed.

Figure 9:
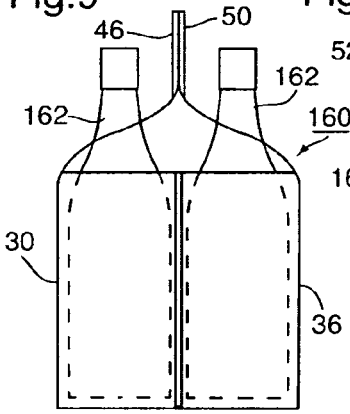
FIGS. 9 and 10 are, respectively, end and side elevation views of another embodiment of the invention.
Figure 10:
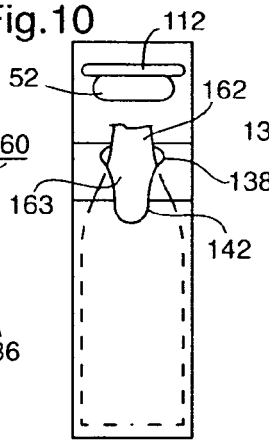

The carrier 160 shown in FIGS. 9 and 10 is especially desirable for packaging tall bottles such as wine bottles with long necks.

As it is shown in FIG. 10, the opening accommodating each of the bottle necks is of the type shown in FIG. 3 with an enlarged upper portion 138 and a lower portion 142. This is beneficial in gripping the bottle better and, also, in showing at least a portion of a label 163 of the bottle.

Figure 11:
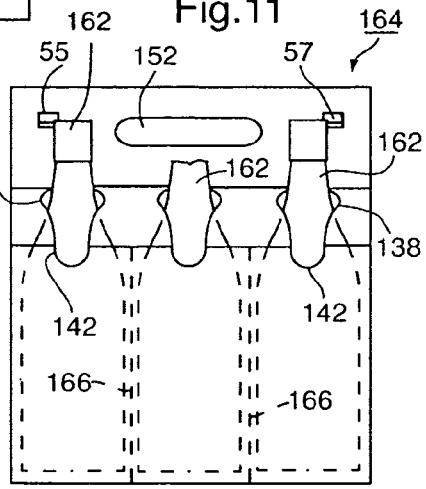
FIG. 11 is a side elevation view of another embodiment of the invention.

The carrier 164 shown in FIG. 11 is essentially the same as the carrier 160 shown in FIGS. 9 and 10, except that it is adapted to hold six tall wine bottles instead of only two.

Two dividers 166 are provided in each of the receptacles to provide six compartments, one for each of the wine bottles 162.

Figure 12:
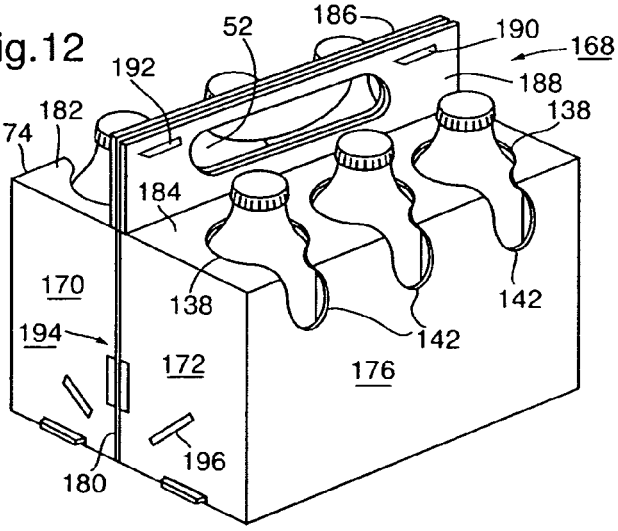
FIGS. 12 and 13 are, respectively, perspective and end elevation views of another embodiment of the invention.
Figure 13:
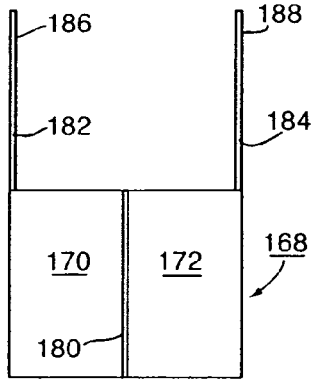

FIGS. 12 and 13 show another carrier 168 made in accordance with the invention. The carrier 168 is used to hold six small, short bottles of beer, sometimes called "nips". The carrier includes outside walls 174 and 176, end walls 170 and 172, horizontal cover portions 184 and 182, and vertical handle portions 186 and 188. Rear end walls are not visible in FIG. 12.

The vertical panels forming the two receptacles of the carrier are joined together as indicated at 180.

Locking structures 190 and 192 are provided in order to lock the various portions of the handle structure together after the bottles have been placed in the carrier.

As with the embodiments shown in FIGS. 9-11, the elongated hole structures shown in FIG. 3 are used. This allows the panels 182 and 184 to be drawn tightly towards the center of the structure so that the edges of the carrier tend to be rounded and the bottles are held tightly.

If desired, the panels 186 and 188 can be glued together during the packaging process rather than using the tabs 190 and 192.

Slot groups 194 and 196 are provided to aid in holding the receptacles open until loaded with bottles during the bottling procedure, as described above with respect to FIGS. 1 and 4.

FIG. 13 is an end view showing the carrier 168 as it looks immediately prior to loading the bottles into the receptacles.

All of the embodiments in FIGS. 6 through 13 have in common the feature that the vertical panel structure 22 or 180, etc., does not extend upwardly to be joined with the upper portions of the outside panels 30, 36, 174 and 176 to form a compound handle. This is because those carriers are designed to hold bottles or cans which are to be primarily prepackaged and delivered as six-packs, two-packs, four-packs, twelve-packs, etc., to grocery stores, alcoholic beverage stores, convenience stores, etc., for retail sale.

The compartments for the beverage containers are dimensioned so as to be only slightly larger than the containers they receive, so that the package can be made as tight as possible and so as to minimize the usage of materials. Moreover, the tight structure allows the further minimization of materials by shortening the central vertical panel structure and using only the upper extensions of the outside walls as handles.

It should be understood, of course, that the vertical central panel structure can be extended upwardly to join with the upper portions of the outside wall panels to give added strength, where needed.

Figure 14:
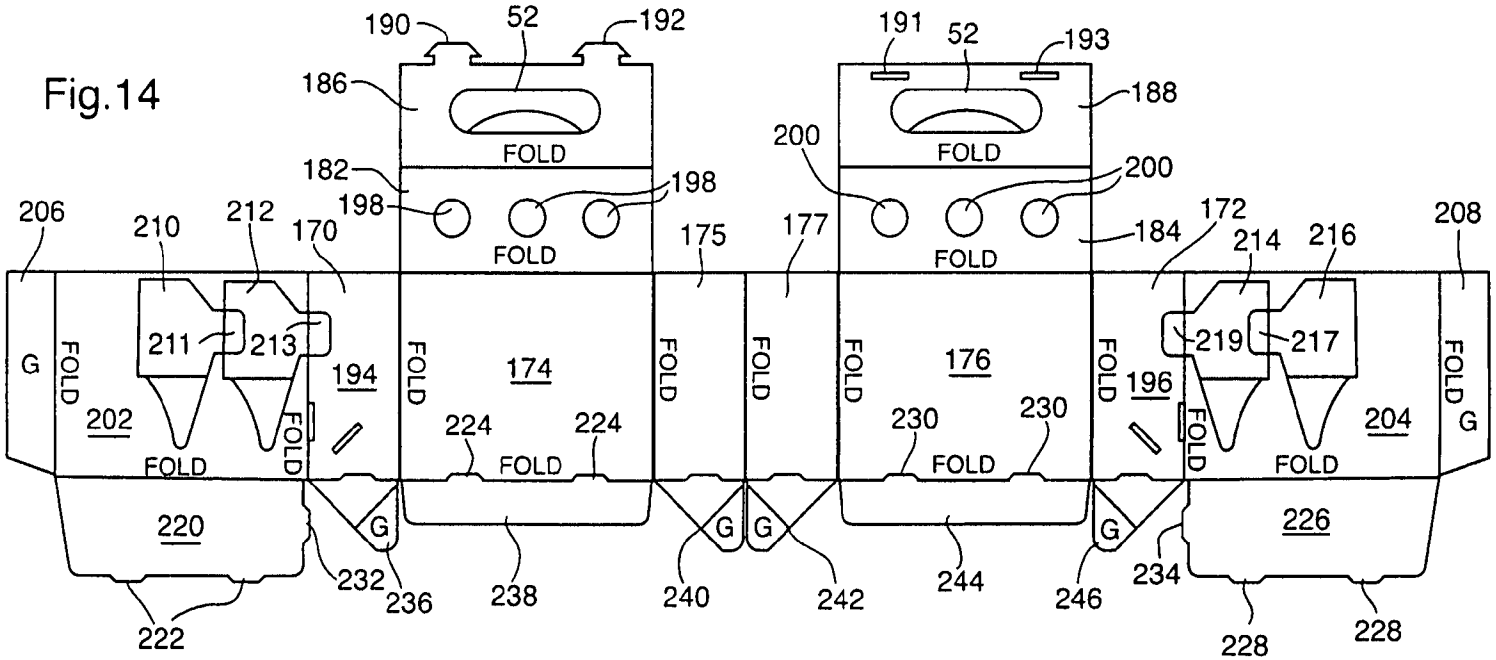
FIG. 14 is a top plan view of a blank for another embodiment of the invention.

FIG. 14 is a blank used to make a carrier which is almost the same as the carrier 168 shown in FIG. 12 except that it has six circular holes 198, 200 instead of the elongated holes shown in the FIG. 12 structure.

As with the FIG. 5 blank, the blank shown in FIG. 14 is designed for use with an in-line gluer.

The wall panels 170, 172, 174 and 176 are shown, as well as rear end panels 175 and 177 which are not visible in FIG. 12.

Vertical support panels 202 and 204 are shown, with flanges 206 and 208 extending from the left and right edges of the blank, as shown.

Four dividers 210, 212, 214 and 216 are shown. Each has a tab 211, 213, 217 or 219, respectively, which is glued to the opposing outside wall 174 or 176 in order to form the dividers, as described in greater detail in several of the above-identified patent applications.

Wide flanges 220 and 226 extend, respectively, from the lower edges of panels 202 and 204. Each wide flange has two tabs 222 or 228 which mate with slots 224 or 230 when the carrier is unfolded, so as to hold the flanges in place.

Side tabs 232 and 234 extend from the flanges 220 and 226. These cooperate with the locking slots 194, 196 to hold the receptacles open while they are being loaded with products. Narrower flanges 238 and 244 extend downwardly from the panels 174 and 176. Triangular panels of the type described above and shown in FIG. 5 are provided at 236, 240, 242 and 246. They function the same as those shown in the FIG. 5 structure to form automatically unfolding bottom structures when the carrier is unfolded.

The locking tabs 190 and 192 shown in FIG. 12 are shown in greater detail in FIG. 14. Each is a projection with two barbs extending outwardly at the sides. Each tab 190, 192 extends from the end of the panel 186.

Slots 191 and 193 are provided in the upper edge of the panel 188 in a position to receive the tabs 190, 192. When the panels 186 and 188 are brought together in order to fasten them to one another, tabs 190 and 192 are bent over and they are inserted through the slots 191 and 193 until the barbs catch. Thus, the tabs 190 operate to secure the two panels 186 and 188 together. Lock structures like the structures 55, 57 in FIG. 1 can be used instead, if desired.

Figure 16:
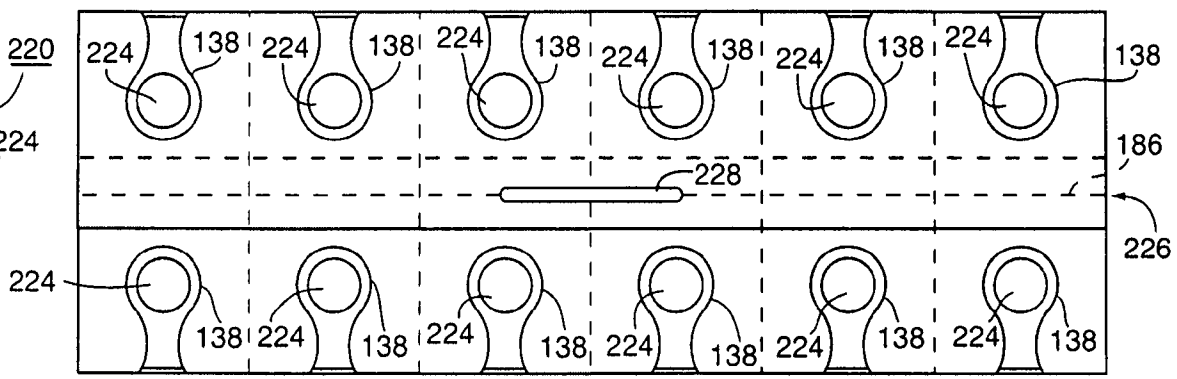
FIG. 16 is a top plan view of the carrier shown in FIG. 15.
Figure 15:
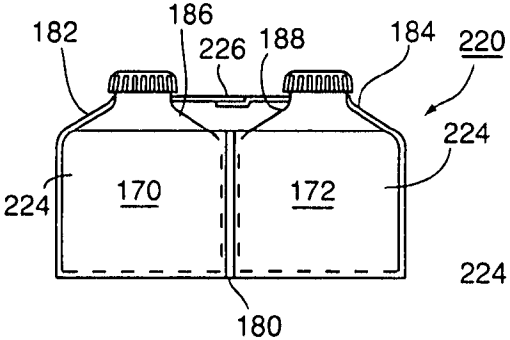
FIG. 15 is an end elevation view of a further embodiment of the invention.

FIGS. 15 and 16 show a further embodiment of the invention in which the carrier 220 has a flat top and a central slot 228 (FIG. 16) in the flat top to be used as a handle instead of an upstanding handle such as in the embodiments shown in the previous figures of the drawings. Again, stubby bottles of beer 224 are shown packaged in the carrier 220. The portions 182, 186, 184 and 188 are folded over to embrace the bottle tops, as in the FIGS. 12 and 13 embodiment, but, the upper portions 186 and 188 are not bent upwardly. Instead, they are overlapped and glued together along a seam 226 (see FIG. 16). This seam is formed after the bottles 224 have been loaded into the carrier. The panels 186 and 188 are pulled tightly towards one another and overlapped and glued together.

As it is shown in FIG. 16, the structure is used to form a twelve-pack. It also can be used to make a six-pack or a twenty-four-pack carrier, as needed and desired.

It should be understood that, in the blanks shown in FIGS. 5 and 14, areas to be glued are marked "GLUE" or "G", and fold lines are marked "FOLD".

Single-Bottom Carrier

Figure 18:
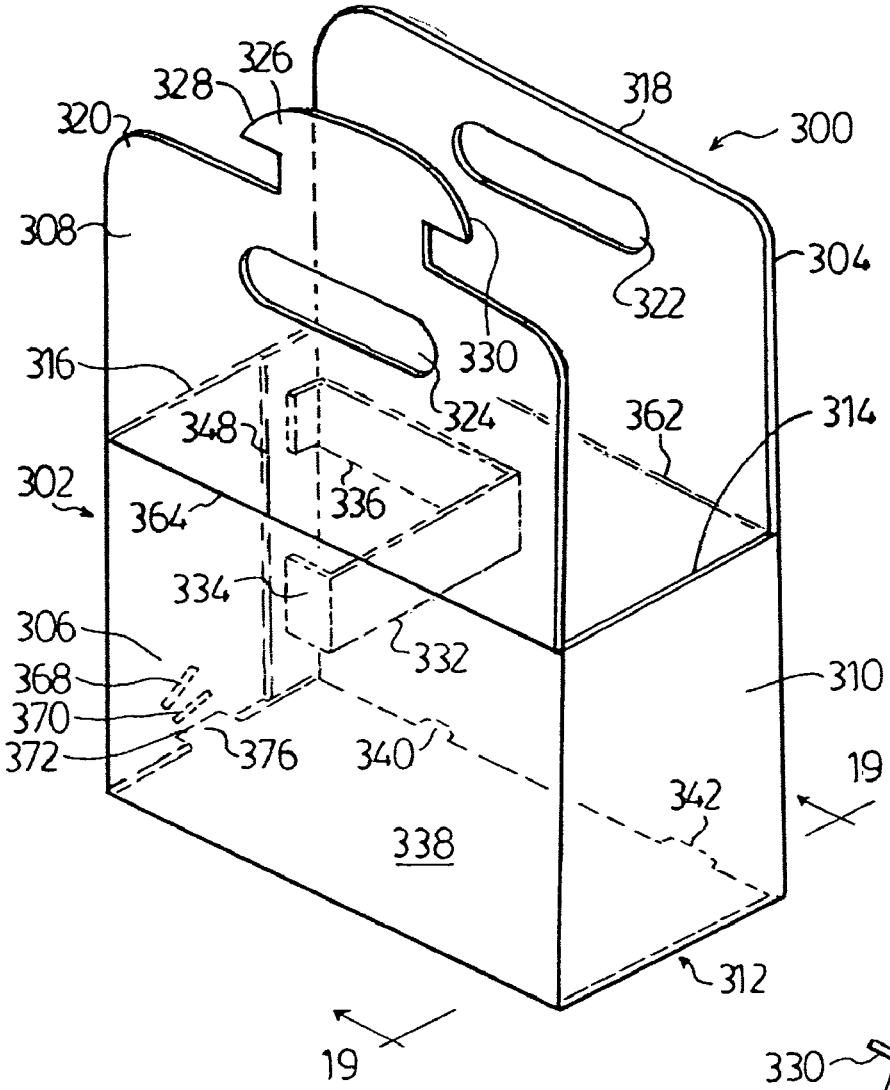
FIG. 18 is a perspective view of a further embodiment of the invention.

FIG. 18 is a perspective view of a single-bottom carrier using the principles of the present invention.

The carrier 300 uses a single receptacle 302 of the same type as the two receptacles 24, 25 used in FIG. 1 and in other embodiments of the invention described above.

The carrier includes four side walls 304, 306, 308, and 310, side walls 310 and 306 being called "end walls", and side walls 304 and 308 being called "lateral side walls". In the particular embodiment shown in FIG. 18, the lateral walls are substantially longer in the horizontal direction. However, the relative lengths of those walls can be different, depending on the requirements of the carrying task at hand.

Each of the lateral walls has an upper edge 318 or 320, and each of the end walls has an upper edge 314 or 316. The lateral walls are substantially taller than the end walls. This gives substantial material above the edges 314 and 316 in order to form a cover and handle structure for the carrier.

The receptacle 302 has a bottom wall structure 312 which is the same as the bottom wall structures for the receptacles shown in the embodiments described above.

Each of the lateral side walls has, near its upper edge 318 or 320, a handle hole 324 or 322. Those handle holes have the same size and elongated oval shape.

Extending from the upper edge 320 of the lateral wall 308 is a projection or flap 326 with barbs 328 and 330 on opposite sides. The projection 326 is dimensioned so as to be capable of being wrapped around the upper edge 318 of the opposite lateral wall and forced through the openings 322 and 324 to lock the upper areas of the lateral side walls together and form a unified hand hole structure for carrying the carrier. In this respect, this embodiment is similar to the embodiment shown in FIG. 4 and described above.

Alternatively, other latching mechanisms such as those shown in FIGS. 1, 7, 12, etc., can be used instead.

A divider structure 332 is provided. It is formed by material cut out from one side wall 304. This leaves an opening 336. The divider is secured between the two lateral side walls 304 and 308 with the use of a tab 334 at one end which is glued to the inside surface of the lateral side wall 308.

The four walls of the carrier are secured together by means of a flange 348 which is glued to the inner surface of the far edge of the end wall 306.

Each lateral side wall 304 and 308 has a horizontal fold line 362 or 364, which is optional, to facilitate bending of the top portions of the lateral side walls to form a cover over the carrier.

Figure 20:
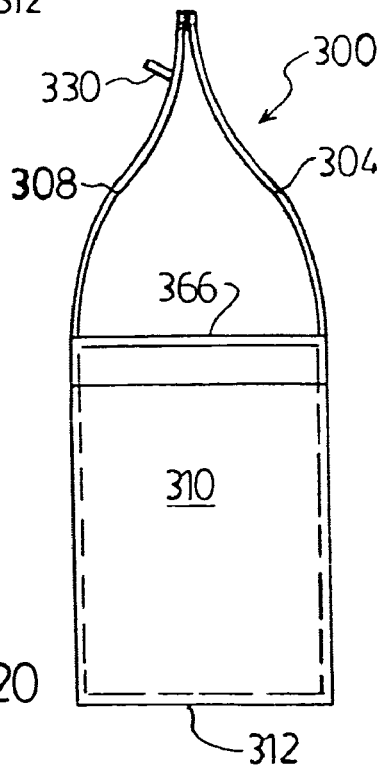
FIG. 20 is an end elevation view of the carrier of FIGS. 18 and 19.

FIG. 20 is an end elevation view of the carrier 300 of FIG. 18 with a container 366 inside. Although the container can be any of a plurality of different types of containers, the container 366 shown is a cylindrical beverage can of a size predetermined to fit snugly into the carrier.

The carrier 300 is closed by bending the upper portions of the lateral side walls 304 and 308, wrapping the projection 326 around the upper edge of the side wall 304, and inserting the projection 326 through the openings 322 and 324 where the barbs 328 and 330 catch on the edges of the hand hole 324 and secure the two lateral side walls together at their top edges. A hand hole remains for a person to insert his or her fingers, as indicated at 324 in FIG. 23.

Figure 19:
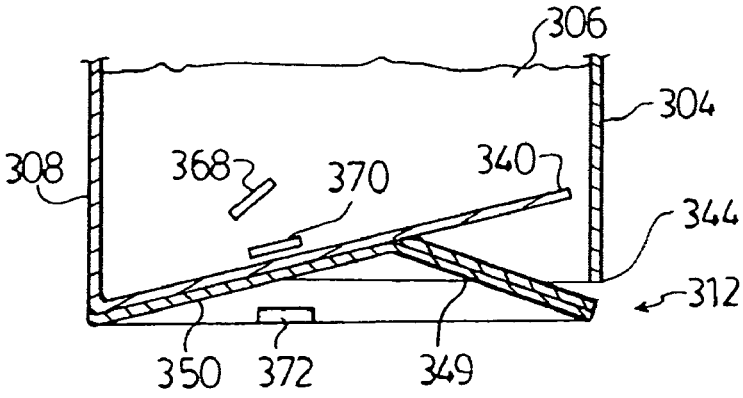
FIG. 19 is a cross-sectional partially broken-away view taken along line 19-19 of FIG. 1.
Figure 21:
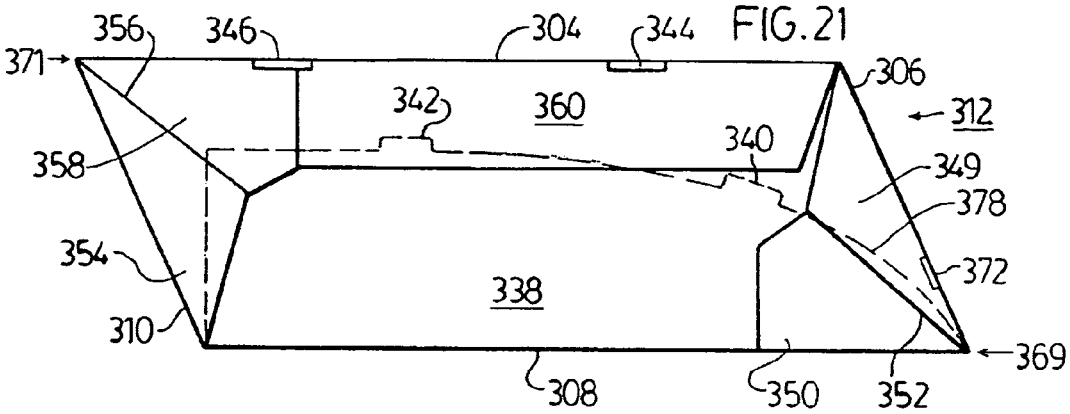
FIG. 21 is a bottom plan view of the carrier of FIGS. 18-21, with the carrier partially unfolded.
Figure 22:
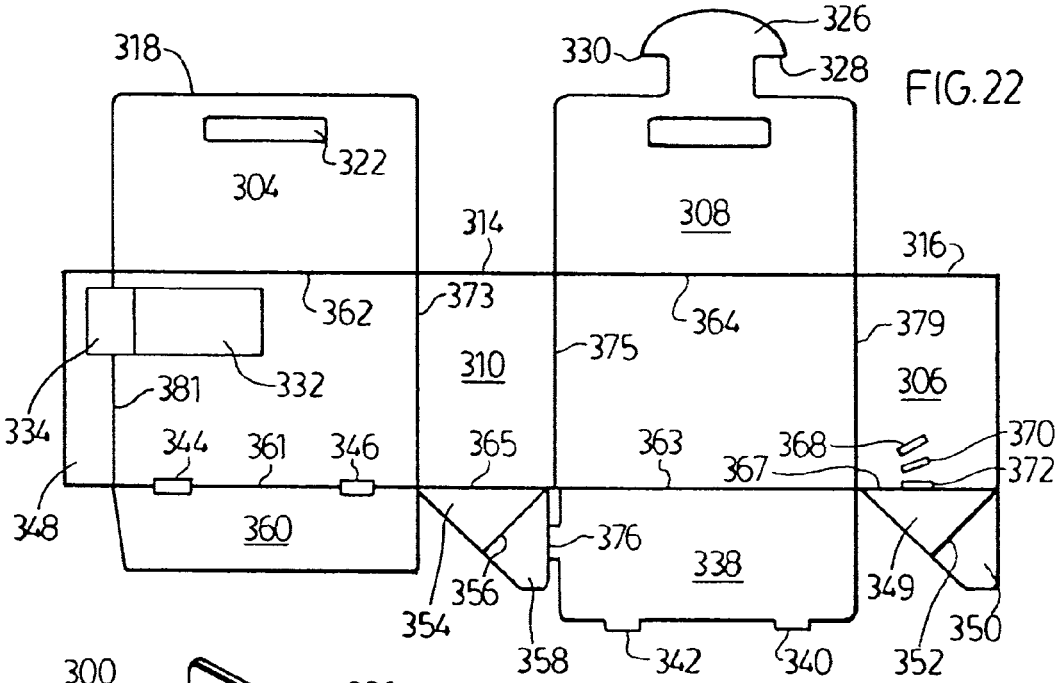
FIG. 22 is a top plan view of a blank used to make the carrier of FIGS. 18-21.

The bottom wall structure 312 of the carrier is shown in substantial detail in FIGS. 19, 21, and 22, as well as FIG. 18.

The bottom structure 312 is made up of four flanges which extend from the lower edges of the four side walls of the carrier.

Referring particularly to FIG. 22, a long but relatively narrow flange 360 is secured along a fold line 361 to the bottom edge of the lateral panel 304.

Another relatively long flange 338 is secured to the bottom edge of the panel 308 along a fold lie 63. The panel 338 is relatively wider than the flange 360 and, in fact, spans entirely across the width of the bottom structure 312. It locks into the opposite lateral side wall 304 by means of two tabs 342 and 340 which fit into slots 344 and 346.

The flange 338 also has a tab 376 extending from one side edge. This tab fits into one of the slots 368, 370, and 372 in the end wall 306 (see FIG. 18 as well as FIG. 22) as the flange 338 is rotating downwardly during unfolding of the carrier. This feature, which has been described in greater detail in the above-identified co-pending patent applications, assists in holding the flange 338 in an intermediate position before it is fully open so as to prevent the carrier from relapsing into its folded position due to the resilience of the cardboard used in making the carrier.

The bottom structure also includes a flange 354 secured along the bottom edge of end wall 310 along a fold line 365, and another flange 349 secured along fold line 367 to the bottom edge of end wall 306. A tab 358 is secured to the flap 354 along a diagonal fold line 356, and a flap 350 is secured to the flange 349 along a diagonal fold line 352.

The side walls are secured together along vertical fold lines 373, 375, and 379, and the tab 348 is secured to the left edge of panel 304 along a fold line 381.

As is shown most clearly in FIG. 21, the tab 358 is glued to the long flange 360, and the tab 350 is glued to the wide flange 338.

FIG. 21 shows the bottom structure 312 partially unfolded. As the opposite edges are pressed towards one another, as indicated by arrows 369 and 371, the connection of the flanges 338 and 360 with the end flanges automatically opens the bottom structure to a horizontal position as shown in FIG. 18. During the movement, the right edge of the flange 338 bends as shown at 378 in FIG. 21, but eventually straightens out and the tab 376 slips into one of the slots 368 or 370 and props the carrier open. Thus, the carrier can stand on a horizontal surface alone, and both hands of a worker can be used to fill the carrier.

Alternatively, in a bottling or packaging line in a beverage plant, the machinery need not hold the carrier open while the machinery automatically inserts containers into the carrier.

The bottom structure 312 is notable for its strength. This is due to a number of factors, including the overlay of flanges, one on top of the other in various portions of the bottom wall, thus providing multi-ply strength.

Particularly notable is the fact that the top flange 338 extends all the way across the bottom and thus provides extraordinary support not provided by other similar bottom structures. The flange 338 does double duty by serving as a propping member to prop the carrier open while it is being filled.

In addition, with the tabs 340 and 342 fitting into slots in the opposing lateral side wall, the broad flange 338 serves the additional function of locking the bottom panels together. This happens either when a worker or a machine presses downwardly on the panel 338, or simply when objects to be carried in the container are loaded into it and their weight rests upon the flange 338. The flange 338 further is locked in position when the tab 376 fits into the slot 372.

Figure 23:
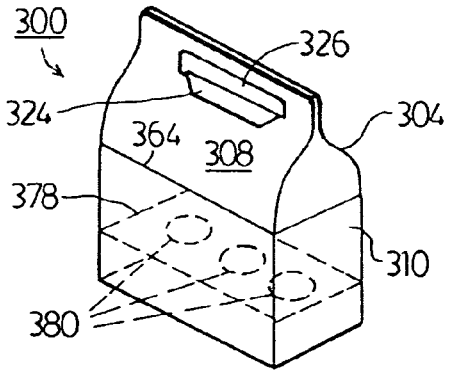
FIG. 23 is a perspective view of the carrier of FIG. 18 after the handle structures have been latched together, and with a modification thereof.

As it is shown in FIGS. 20 and 23, the upper portions of the lateral side walls 304 and 308 come together and are secured to one another or held together by inserting the hand through both hand holes simultaneously, thereby providing a cover over the contents being carried in the carrier. Moreover, the carrier 300 is simple and relatively inexpensive to manufacture.

The carrier 300 is very well suited to uses in carrying many objects. However, it is especially advantageous in carrying beverage containers and food items. The carrier, like the carriers provided above, provides a cover so that a variety of food items can be carried in open containers without danger of contamination by falling objects.

Open containers of coffee, tea, or other beverages, soup, sandwiches, etc., can be carried with protection form the cover.

FIG. 23 shows the use of an insert 374 having downwardly-extending legs resting on the bottom of the carrier. The insert has holes 380 in its top to receive ice cream cones or cups. Even very tall cones containing soft ice cream will fit into the carrier. The cover even matches the shape of the tops of such cones.

The above description of the invention is intended to be illustrative and not limiting. Various changes or modifications in the embodiments described may occur to those skilled in the art. These can be made without departing from the spirit or scope of the invention.

What is claimed is:

1. A carrier comprising a receptacle having four side walls joined together along vertical fold lines, and a bottom wall joined to said side walls along horizontal fold lines, said side walls comprising two end walls opposite one another and two lateral walls opposite one another, said lateral walls being substantially longer than said end walls, and taller than and extending above said end walls, each of said lateral walls having an upper edge and a handle structure adjacent said upper edge, said bottom wall comprising a plurality of flanges, each extending downwardly from the lower edge of one of said side walls, each of two of said flanges extending from opposite ones of said side walls being secured to an adjacent one of said flanges so that said flanges fold upwardly into said receptacle when said carrier is folded, and fold downwardly to form said bottom wall when said carrier is unfolded, one of said flanges extending from one of said lateral walls being shaped and positioned to engage one of said end walls within said receptacle when said carrier is partially unfolded and prop said carrier open to deter relapse of said carrier to a folded position.

2. A carrier as in claim 1 with one of the flanges extending from one of said lateral walls spanning substantially the entire distance between said lateral walls when said carrier is unfolded.

3. A carrier as in claim 2 in which said one flange is the uppermost flange forming said bottom wall.

4. A carrier as in claim 2 in which said one flange extends to the opposite one of said lateral walls and has at least one tab extending from one edge, said opposite lateral wall having a recess for receiving said tab to engage said one edge of said one flange and hold it down.

5. A carrier as in claim 1 in which the portions of said lateral walls which are located above said end walls can be bent towards one another to bring said handle structures together, and a latch structure for releasably attaching said handle structures together to form a single unified handle structure.

6. A carrier as in claim 2 including a divider structure consisting of a divider member secured between said lateral walls at a location sufficiently far above said bottom wall to avoid stoppage of the movement of said one flange as it moves from a folded to an unfolded position.

7. A carrier comprising a receptacle having four side walls joined together along vertical fold lines, and a bottom wall joined to said side walls along horizontal fold lines, said side walls comprising two end walls opposite one another and two lateral walls opposite one another, said lateral walls being longer than said end walls, and at least one of said lateral walls being substantially taller than and extending above said end walls, said one lateral wall having an upper edge and a handle structure adjacent said upper edge, said bottom wall comprising a plurality of flanges, each extending downwardly from the lower edge of one of said side walls, each of two of said flanges extending from opposite ones of said side walls being secured to an adjacent one of said flanges so that said flanges fold upwardly into said receptacle when said carrier is folded, and fold downwardly to form said bottom wall when said carrier is unfolded, one of said flanges extending from said lateral walls spanning substantially the entire distance between said lateral walls when said carrier is unfolded, said one flange being dimensioned and positioned to engage one of said end walls within said receptacle, when said carrier is partially unfolded and prop said carrier open to deter relapse of said carrier to a folded position.

8. A carrier as claimed in claim 7 in which said one flange is the uppermost flange forming said bottom wall.

9. A blank for forming a foldable carrier, said blank comprising (a) first and second vertical support panels, each of said panels having first and second opposed longitudinal side edges, and two opposed transverse end edges, (b) first and second end-wall panels, each having first and second longitudinally-extending opposed side edges and transversely-extending opposed end edges, said end edges of said support panels being substantially longer than said end edges of said end-wall panels, (c) one of said end edges of each of said first and second end-wall panels being secured to one of said end edges of one of said support panels along a fold line, (d) the other of said end edges of one of said first and second end-wall panel being secured to a second end edge of one of said support panels along a fold line, (e) a first one of said transverse edges of each of said end-wall panels and said support panels being aligned with one another to define a bottom plane for said carrier, (f) a bottom flange extending from each of said one transverse edges, each of said bottom flanges being shaped to be joined selectively with other of said bottom flanges to form an automatically-unfolding bottom wall structure joined with said side-walls to form a receptacle when said carrier is unfolded; and at least one of said bottom flanges extending from one of said support panels being shaped and positioned to automatically interfere with one of said end wall panels to deter the relapse movement of said carrier and hold the carrier open when it is partially unfolded.

10. A blank as in claim 9 in which said first and second end-wall panels have the same transverse width, and said support panels have vertical dimensions substantially greater than said end-wall panels.

11. A blank as in claim 10 in which each of said support panels has a handle hole positioned to align with the handle hole in the other of said support panels when said support panels are brought together, and a lock structure to hold said panels together.

12. A blank as in claim 11 in which said lock structure includes a projection extending from the upper edge of one of said support panels, with engagement prongs extending transversely from said projection to engage the edges of said hand holes when it is wrapped around the upper edge of said other support panel and pushed through said hand holes.

* * * * *